United States Patent [19]

Jamaluddin

[11] 4,322,203

[45] Mar. 30, 1982

[54] PIPE BURNOUT OVEN WITH POLLUTION CONTROL

[76] Inventor: Aziz A. Jamaluddin, P.O. Box 7060, Woodlands, Tex. 77380

[21] Appl. No.: 242,017

[22] Filed: Mar. 9, 1981

[51] Int. Cl.[3] ..... F26D 7/04; C21B 7/22

[52] U.S. Cl. ..... 432/72; 266/144; 432/186

[58] Field of Search ..... 432/72, 186, 190, 200, 432/241; 266/144

[56] References Cited

U.S. PATENT DOCUMENTS

| | | | |
|---|---|---|---|
| 4,240,787 | 12/1980 | Jamaluddin | 432/72 |
| 4,242,084 | 12/1980 | Jamaluddin | 432/72 |
| 4,255,132 | 3/1981 | Carthew | 432/72 |

*Primary Examiner*—John J. Camby
*Attorney, Agent, or Firm*—Neal J. Mosely

[57] ABSTRACT

A batch type pipe burnout oven is provided with improved pollution control and heat recovery features. The oven is elongated with an end opening for introduction of a movable support or cart with pipe supported thereon. The oven is brought to burnout temperature faster than prior art ovens and an improved system is provided for pollution control by incineration of hydrocarbon fumes together with recovery of heat which results in superior fuel economy. The oven is provided with a pair of oppositely positioned plenums along the sides thereof which supply heated air in large volume and high velocity through a plurality of nozzle slots to the pipe-containing chamber and are themselves supplied from a recirculation burner chamber on the top of the oven. A relatively small volume of air, laden with volatile, combustible fumes, is withdrawn from the oven at a relatively low velocity by an exhaust fan. This fume-laden air is passed through a gas-fired incinerator in a combustion chamber where the fumes are completely burned and the combustion products raised to a temperature of about 1400° F. These combustion products are passed through a heat exchanger in the burner chamber on top of the oven and then through another heat exchanger to preheat combustion air for the gas-fired burners prior to being exhausted to atmosphere.

14 Claims, 6 Drawing Figures

PIPE BURNOUT OVEN WITH POLLUTION CONTROL

BACKGROUND OF THE INVENTION

1. Field of the Invention

This invention relates to new and useful improvements in batch type pipe burnout ovens and more particularly to ovens which are efficiently heated and include air pollution control and heat recovery features.

2. Description of the Prior Art

In prior art-type coating operations, metal pipes are first burned out either in a batch type or continuous type oven. Pipes are stacked on a cart and wheeled inside a hot chamber and the temperature gradually increased to 750° F. Normally it takes about 4 hours for the temperature to reach 750° F. In most prior art ovens, the oven chamber is about 50' long having a combustion chamber on top or on the opposite of the door, with one blower and one burner. The oven is equipped with a supply plenum on one side. The blower delivers the heated air to the supply plenum on one side. A return air plenum on the other side receives the air which has passed over the pipe and returns it to the combustion chamber. This is a very slow process and the velocity of air within the oven chamber is very slow. Also, when the temperature within the oven chamber reaches about 300°-350° F. the oven starts smoking as the oil and grease begins to burn. In some cases, direct fired incinerators have been used in the exhaust stack. Comprehensive heat recovery has been difficult to achieve with such equipment. After the temperature of 750° F. is reached, the pipes are pulled out of the oven and cooled down. The internal surfaces of the pipes are then sand blasted and subsequently coated with plastic or resinous coatings in one or more stages. Finally, the pipes are soaked in a separate oven at 500°-550° F. for a period of time so that the plastic coating applied on the inside surface is cured.

SUMMARY OF THE INVENTION

It is one object of this invention to provide a new and improved batch type burnout oven having a high heating efficiency and having associated pollution control and heat recovery features.

Another object of this invention is to provide an improved pipe burnout oven which brings a load of pipe to burnout temperature in a short period of time by recirculation of air from the oven chamber at a high velocity and high volume to a high capacity burner and then back to the oven through oppositely positioned plenum chambers having spaced nozzle slots.

Another object of this invention is to provide an improved pipe burnout oven in which air is slowly exhausted to atmosphere through a direct fired incinerator which burns the combustible fumes and the heat produced is recovered in the main burner chamber and in heating combustion air for the burners in the burner chamber.

Other objects of this invention will become apparent from time to time throughout the specification and claims as hereinafter related.

These and other objects of the invention are achieved by a novel batch type pipe burnout oven provided with improved pollution control and heat recovery features. The oven is elongated with an end opening for introduction of a movable support or cart with pipe supported thereon. The oven is brought to burnout temperature faster than prior art ovens and an improved system is provided for pollution control by incineration of hydrocarbon fumes together with recovery of heat which results in superior fuel economy. The oven is provided with a pair of oppositely positioned plenums along the sides thereof which supply heated air in large volume and high velocity through a plurality of nozzle slots to the pipe-containing chamber and are themselves supplied from a recirculation burner chamber on the top of the oven. A relatively small volume of air, laden with volatile, combustible fumes, is withdrawn from the oven at a relatively low velocity by an exhaust fan. This fume-laden air is passed through a gas-fired incinerator in a combustion chamber where the fumes are completely burned and the combustion products raised to a temperature of about 1400° F. These combustion products are passed through a heat exchanger in the burner chamber on top of the oven and then through another heat exchanger to preheat combustion air for the gas-fired burners prior to being exhausted to atmosphere.

DESCRIPTION OF A PREFERRED EMBODIMENT

Figure 1:
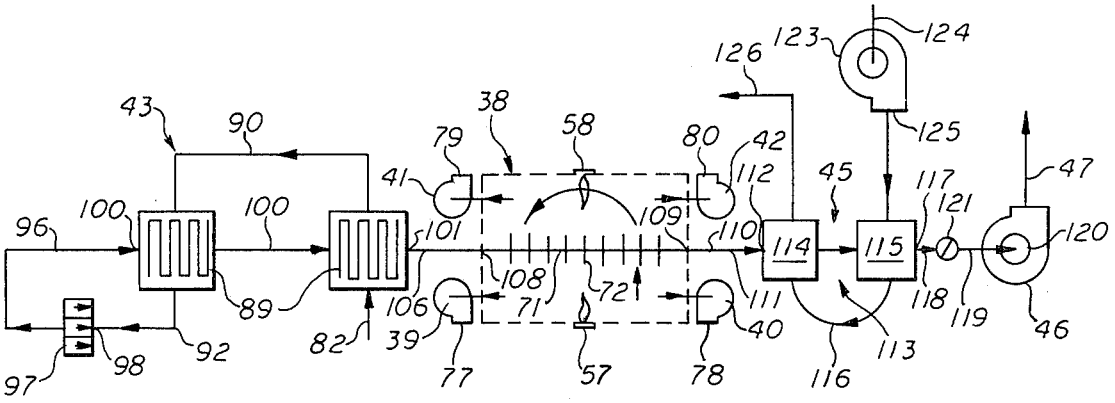
FIG. 1 is a schematic view of the system of heating and heat recovery and air pollution control for a pipe burnout oven constituting a preferred embodiment of this invention.

In the drawings, there is shown a new and improved pipe burnout oven and system of heating and of air pollution control and heat recovery. The oven shown is a batch type oven which operates a high air velocity and is capable of bringing a quantity of pipe in the oven from a temperature of about 70° F. to 750° F. in one and one half hours as compared to prior art ovens which require four hours or more for initial heating. Also, in this oven, there is a complete burn off of hydrocarbon fumes that are produced which results in a very thorough air pollution control and a substantial heat recovery and energy saving.

Figure 4:
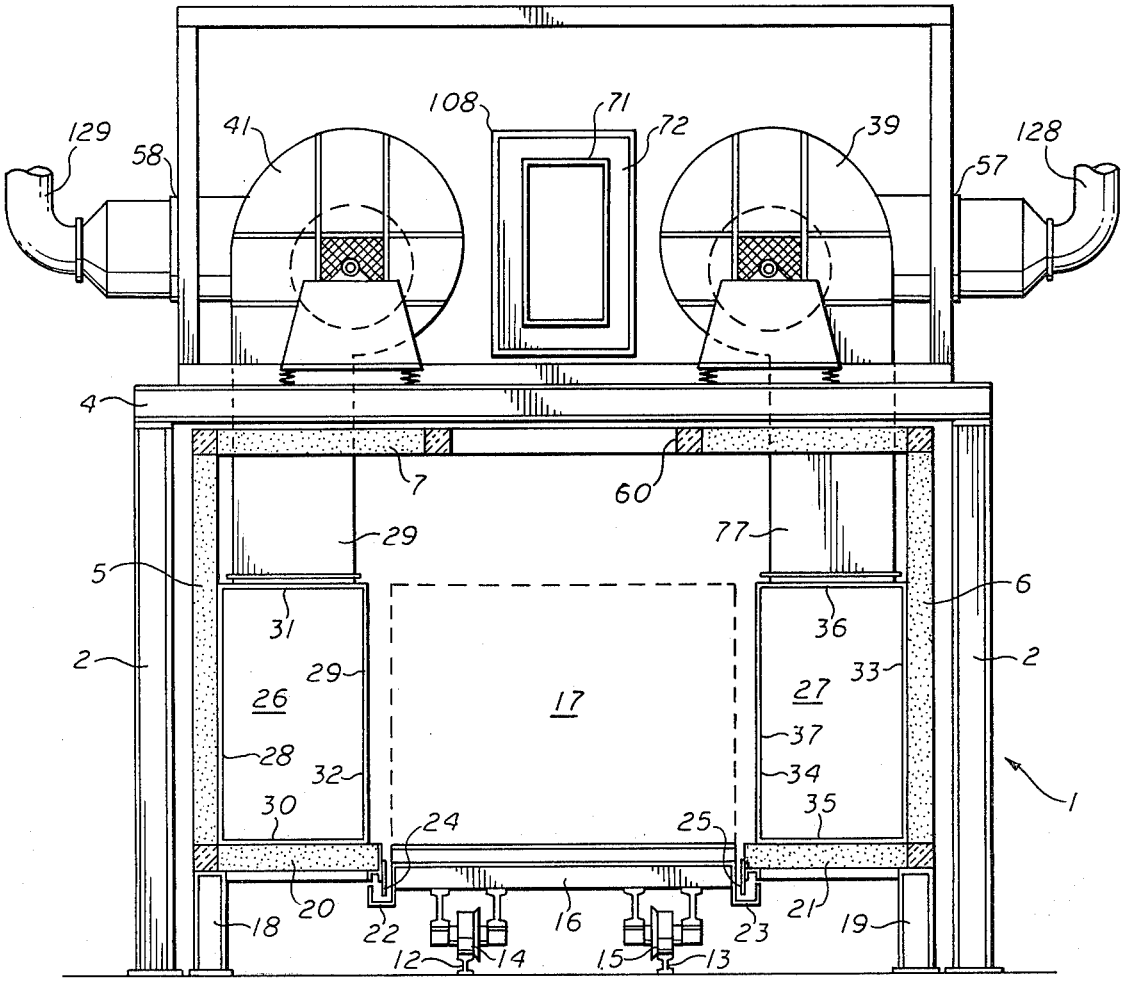
FIG. 4 is a sectional view taken on the line 4—4 of FIG. 2.
Figure 3:
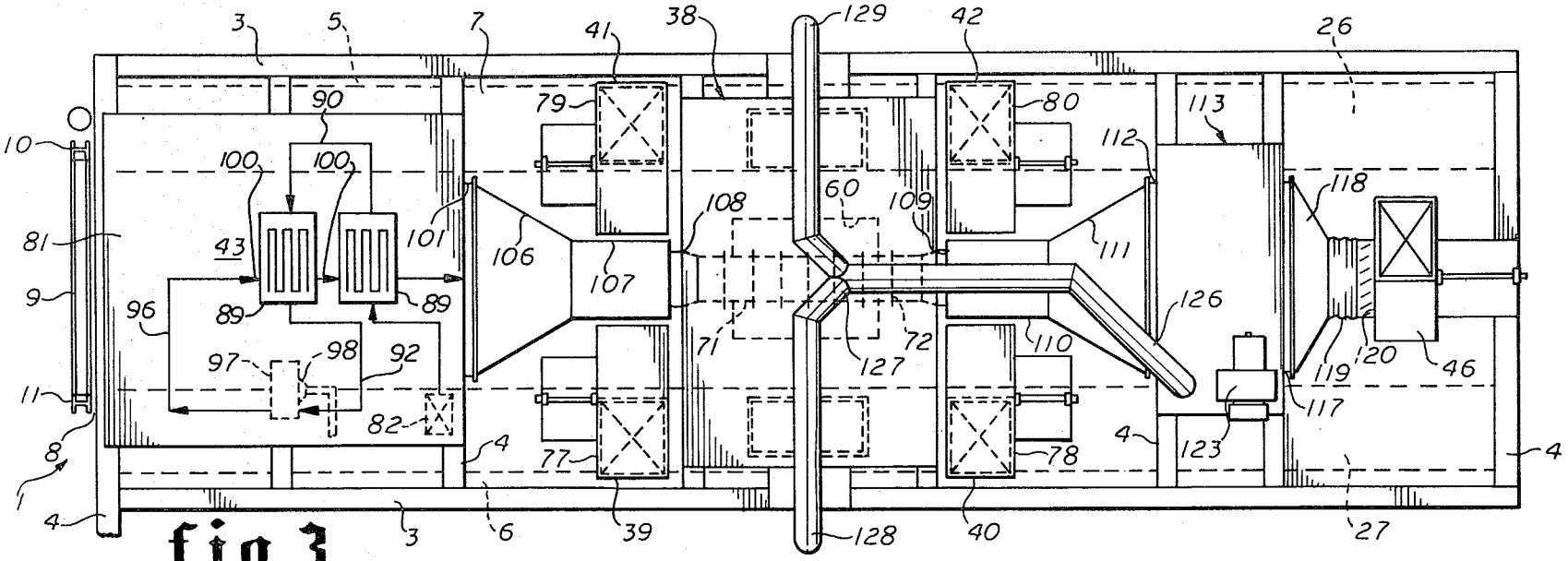
FIG. 3 is a top plan view of the apparatus shown in FIG. 2.
Figure 2:
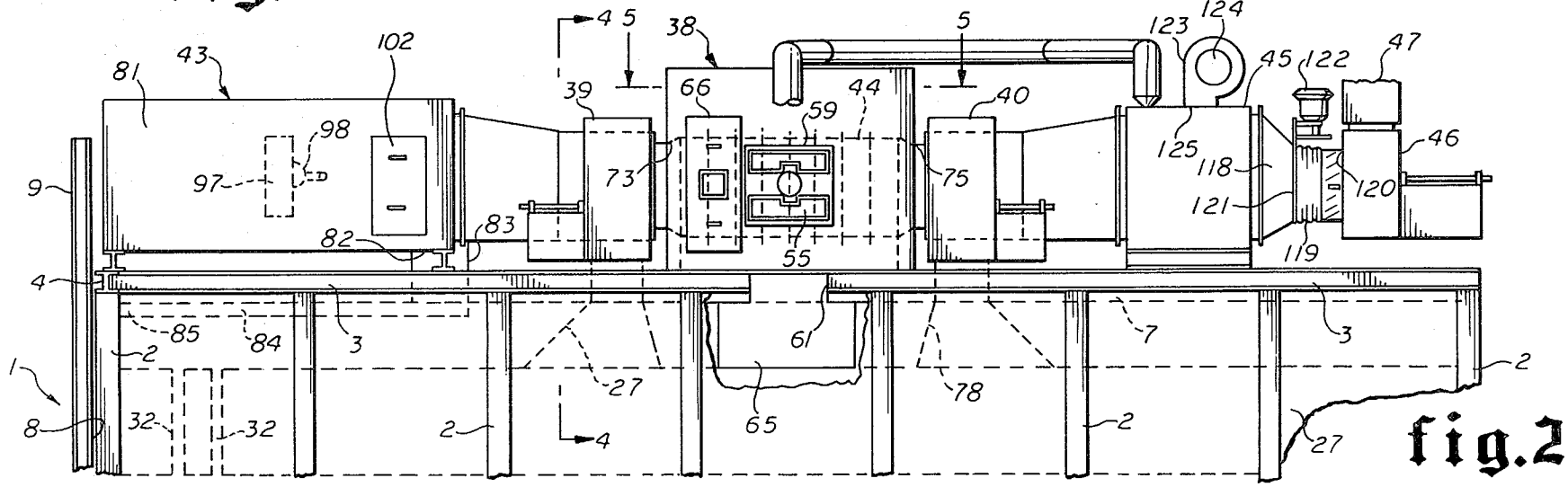
FIG. 2 is a view in side elevation of a pipe burnout oven constituting a preferred embodiment of this invention.

Referring to the drawings, and more particularly to FIGS. 2-4, there is shown an oven 1 which comprises an elongated rectangular framework supporting a plurality of insulated panels. The supporting framework comprises a plurality of vertically extending structural steel supports 2, longitudinally and horizontally extending supports 3, and laterally and horizontally extending supports 4. The supports 2, 3 and 4 comprise steel H-beams or the like and are preferably joined by welding into a rigid framework.

Oven 1 is enclosed by longitudinally extending, vertical side walls, consisting of thick-walled insulated panels 5 and 6, and a longitudinally extending top wall, consisting of thick-walled insulated panel 7. Oven 1 is open at one end for introduction of pipe to be processed and has a vertically sliding end door 9 supported for vertical movement between vertical supporting H-beams 10 and 11. A pair of rails 12 and 13 extend longitudinally of the oven 1 which support the wheels 14 and 15 of a cart 16 for movement of a load of pipe 17 into and out of the oven. The oven chamber or enclosure 1, consisting of panels 5, 6 and 7, is supported from the top portion of the frame, consisting of supports 4 and a series of shorter, the vertically extending H-beam supports 18 and 19 which also support horizontally extending, bottom insulated panels 20 and 21. The pipe cart 16 has longitudinally extending channels 22 and 23 which cooperate with flanges 24 and 25 on bottom panels 20 and 21 to minimize heat leakage from the bottom of the oven. In a preferred design, the oven chamber 1 has an inside clearance of 50 ft. long by 15 ft. wide by 10 ft. high. Cart 16 which is only slightly shorter than the oven carries a pipe load of about 90,000 lbs. Obviously, these specifications can be varied, as needed, but represent a typical commercial installation.

MAIN OVEN CHAMBER

Oven 1 has plenum chambers 26 and 27 extending longitudinally thereof on opposite sides of the rails 12 and 13. Plenum chamber 26 comprises vertical walls 28 and 29, bottom wall 30 and top wall 31 and is supported on bottom panel 20. Plenum chamber 26 has a plurality of vertical slots or nozzles 32 in wall 29 and spaced along the entire length thereof for directing flow of heated air on to the pipe 17 on cart 16. Plenum chamber 27 similarly comprises vertical walls 33 and 34, bottom wall 35 and top wall 36 and is supported on bottom panel 21. Plenum chamber 27 has a plurality of vertical slots or nozzles 37 in wall 34 and spaced along the entire length thereof in the same manner and the same spacing as the slots or nozzles 32 in wall 29 for directing flow of heated air on to the opposite side of pipe 17 on cart 16. The supply of heated air for heating the pipe to burnout temperature and the control of air pollution from the pipe burnout and recovery of waste energy are provided by equipment carried on top of the supporting frame for the oven.

BURNER SECTION

The burner section 38 is supported on top of oven framework 2, 3 and 4 which draws air from the oven and heats it in a burner which will be subsequently described in more detail. The heated air is recirculated to oven 1 by four blowers 39, 40, 41 and 42. Air is exhausted slowly from oven 1 by exhaust fan or blower 46 through incinerator section 43, where hydrocarbon byproducts are consumed; heat exchanger 44, where additional heat is absorbed; and heat exchange section 45 where heat is given up to incoming combustion air for the burner section. The air from heat exchange section 45 is exhausted by blower 46 to atmosphere at 47. These various components which provide for heating, pollution control and heat recovery will be described in more detail below.

Figure 5:
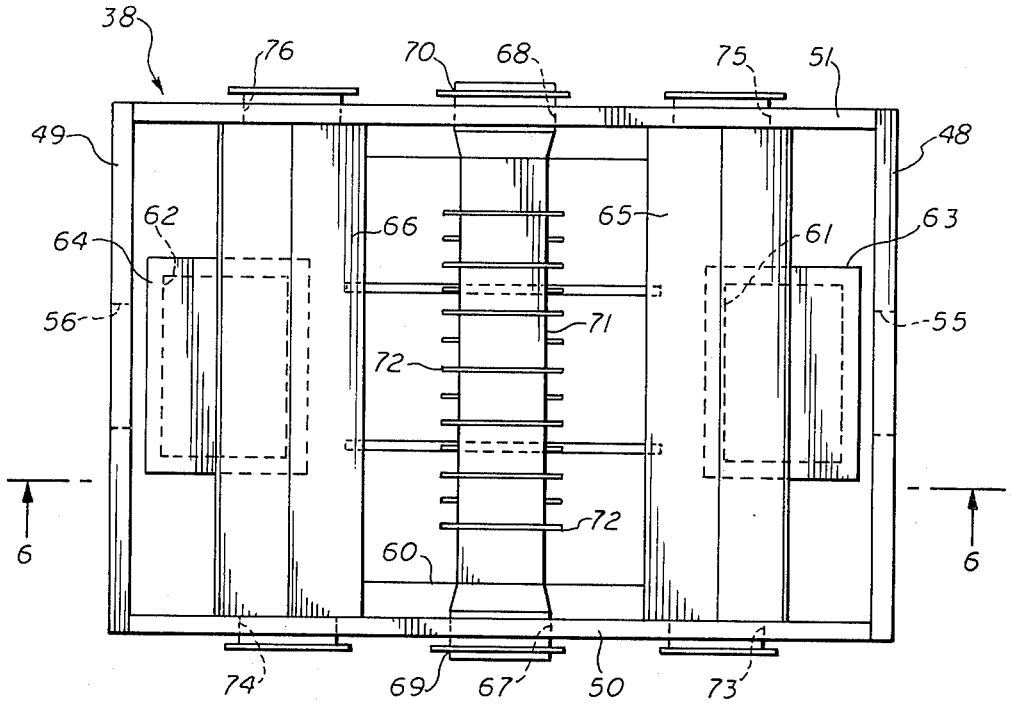
FIG. 5 is a sectional view taken on the line 5—5 of FIG. 1.
Figure 6:
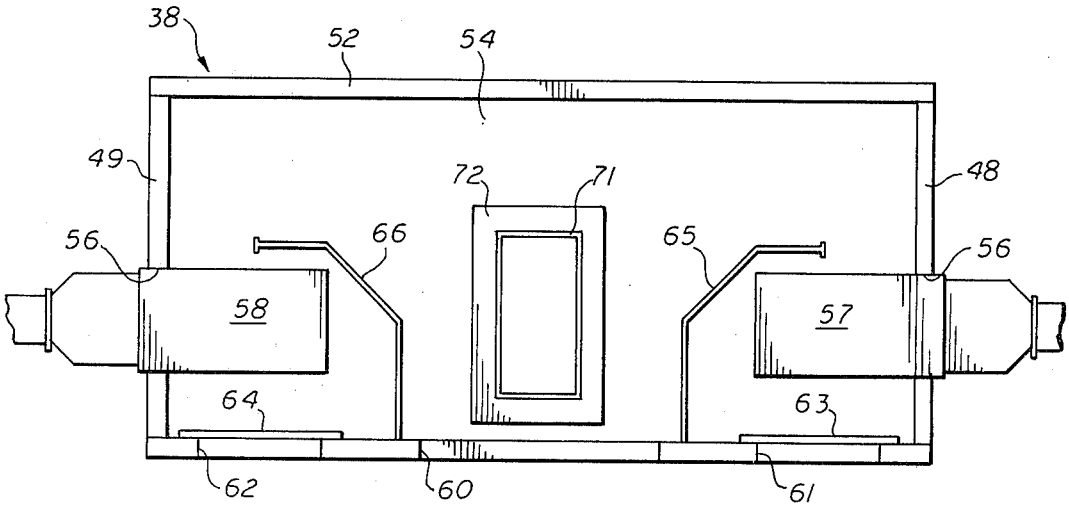
FIG. 6 is a sectional view taken on the line 6—6 of FIG. 5.

The burner section 38 is shown in the schematic view of FIG. 1 and in FIGS. 2 and 3, with details shown more clearly in FIGS. 5 and 6. Burner section 38 comprises a rectangular chamber 54 enclosed by insulated panels, viz. side walls 48 and 49; end walls 50 and 51; top wall 52, and bottom wall 53. Side walls 48 and 49 have openings 55 and 56 in which there are positioned burners 57 and 58. The burners 57 and 58 are conventional gas-fired burners provided with a source of heating gas and with forced supply of preheated air for combustion. Burner 57 is supported on a supporting plate 59 which closes opening 55 and is secured on wall 48 of burner section 38. Burner 38 is similarly supported on a like supporting plate (not shown).

Bottom wall 53 of burner chamber 54 has a central opening 60 which opens into the top of the elongated oven enclosure 1. During most of the operation of oven 1, opening 60 is the only opening for circulation of air from the oven 1 into burner chamber 54. Bottom wall 53 is also provided with a pair of smaller openings 61 and 62, closed by sliding dampers 63 and 64, positioned immediately below the burners 57 and 58. Openings 61 and 62 each have a T-connector 65 (FIG. 2) therein, only one shown, which extends into the top of oven 1 and rests on the top wall of plenum chambers 26 and 27, respectively. T-connectors 65 prevent the oven 1 from being directly exposed to the burners 57 and 58 when dampers 63 and 64 are opened, but allow air from the oven to circulate to the burners. Burner chamber 54 is also provided with access doors 66 on opposite sides thereof for service and observation.

End walls 50 and 51 of burner chamber 54 have openings 67 and 68 in which there are secured the inlet end 69 and outlet end 70 of heat exchange conduit 71, having heat exchange fins 72. End walls 50 and 51 also have openings 73, 74, 75 and 76 for connection to the inlet sides of blowers 39, 40, 41 and 42, respectively. The blowers, in turn, have their respective outlets connected by conduits 77, 78, 79 and 80 to the plenum chambers 26 and 27.

INCINERATOR AND POLLUTION CONTROL SECTION

Incinerator section 43 comprises an insulated, multi-compartment enclosure 81 having a bottom opening 82 receiving fume-laden air from oven 1. Bottom opening 82 is connected to conduit 83 which, in turn, is connected to conduit 84 extending along the top of oven 1 and having an open end 85 for withdrawing fume-laden air from the end of the oven adjacent to door 9.

The incinerator section 43 contains the heat exchanger and incinerator components shown schematically in FIG. 1. These components are of more or less conventional design and are shown schematically in FIG. 3 as well as in FIG. 1. There is a heat exchanger 89 having two portions for two-stage heat exchange. Bottom opening 82 communicates with one side of heat exchanger 89 to conduct fume-laden gases to the other side thereof and thence through passage 90 to return through the other half of heat exchanger 89 for discharge into incinerator unit 97 which includes burner 98 supplied with gas through gas line or conduit 99. The fume-laden air is thus preheated in heat exchanger 89 prior to entering incinerator unit 97.

Incinerator unit 79 and burner 98 are effective to burn the hydrocarbon fumes, and other combustible matter, in the fume-laden air drawn from the oven. The combustion of the combustible components in the fume-laden air is completed largely in passage or chamber indicated schematically as 96. Combustion chamber 96 opens through passage 100 shown schematically as extending through heat exchanger 89 in heat exchange relation with the fume-laden air passing through the heat exchange conduits shown schematically therein. Passage 100 extends from combustion chamber 96 to outlet opening 101 from incinerator unit 43. Incinerator unit 43 is provided with a plurality of access openings 102 (only one shown) which provide for service and maintenance.

Outlet opening 101 from incinerator unit 43 is connected by conduits 106 and 107 to the inlet end 108 of heat exchange conduit 71 in burner section 38. The outlet end 109 of heat exchange conduit 71 is connected by conduits 110 and 111 to the inlet side 112 of heat exchanger 113. Heat exchanger 113 is a two pass heat exchanger comprising heat exchange sections 114 and 115 connected by recirculation chamber or conduit 116. The outlet 117 from heat exchanger 113 is connected by conduit 118 and conduit 119 to the inlet side 120 of exhaust fan 46 which exhausts to atmosphere as indicated at 47. Between conduits 118 and 119 there is provided a vertex damper 121 with automatic control 122.

Fan or blower 123 has an inlet 124 drawing in combustion air from atmosphere and exhausting the same through outlet 125 opening into one side of heat exchanger 113. The combustion air from blower 123 passes through heat exchanger portions 114 and 115 and is exhausted through outlet conduit 126 which extends to a Y-connection 127 leading to conduits 128 and 129 supplying preheated combustion air to burners 57 and 58 in combustion unit 38.

OPERATION

The apparatus described above is a batch type pipe burnout oven with air pollution control and heat recovery features. In prior art-type coating operations, metal pipes are first burned out either in a batch type or continuous type oven. Pipes are stacked on a cart and wheeled inside a hot chamber and the temperature gradually increased to 750° F. Normally it takes about 4 hours for the temperature to reach 750° F. After the temperature of 750° F. is reached, the pipes are pulled out of the oven and cooled down. The internal surfaces of the pipes are then sand blasted and subsequently coated with plastic or resinous coatings in one or more stages. Finally, the pipes are soaked in a separate oven at 500°–550° F. for a period of time so that the plastic coating applied on the inside surface is cured.

The burnout oven described above is an improved batch type oven with air pollution control and heat recovery features. Conventional type burnout ovens require about four hours to raise the temperature of a cold pipe from 70° to 700° F. In the burnout oven described above, the load of pipes 17 is supported on a cart 16 and wheeled inside the elongated oven chamber 1. Air for heating the pipes 17 is heated in burner section 38 by burners 57 and 58. The air is drawn from oven chamber 1 through opening 60 which is located centrally of the oven. The air which is drawn from oven 1 through opening 60 passes around baffles 65 and 66 and is heated by burners 57 and 58 to an elevated temperature and also receives heat from heat exchanger conduit 71 which is conducting the combustion products from the incinerator and air pollution control section 43. The heated air in burner section 38 is circulated by the four high capacity (30,000 SCFM) fans or blowers 39, 40, 41 and 42 to plenum ducts 26 and 27. The high velocity hot air is introduced into oven 1 through air nozzles or slots 32 and 37 which cause the air to impinge on pipes 17 at high velocity. This high volume, high speed circulation of heated air is effective to raise a 90,000 pound load of the pipe 17 from 70° to 750° F. in a period of about one and one-half hours as distinguished from prior art equipment which requires about four hours for the same temperature rise.

At the outlet end of the system, fan or blower 46 vents air at a relatively low volume and low linear velocity to atmosphere as indicated at 47 and controlled by vortex damper 122. Exhaust fan 46 vents air at 10,273 SCFM which is a relatively low circulation rate compared to the 120,000 SCFM recirculation of air between oven 1 and combustion unit 38. The air vented by exhaust fan 46 is drawn from oven 1 through fume incinerator and pollution control unit 43, heat exchange conduit 71 in the burner section 38, and heat exchanger 113 for preheating combustion air supplied to burners 57 and 58.

Air from oven 1 is withdrawn through conduit 84 and opening 82 at a rate of 10,273 SCFM under the influence of exhaust fan 46. This air, which is laden with combustible fumes from the pipe 17, circulates through the two-pass heat exchanger 89 and is preheated to a temperature of about 1,000° F. The fume-laden air from heat exchanger 89 passes incinerator 97 and burner 98 and the combustion is carried out in combustion passage or chamber 96 where the combustibles in the air are completely consumed and the combustion products reach a temperature of 1,400° F. No externally supplied air is required for this combustion. Only the oxygen in the air withdrawn from oven 1 is used. The combustion gases from combustion chamber 96 pass through the air passage 100 and flows over conduits in heat exchanger 89. The combustion products are reduced from 1,400° F. to about 1,000° F. in the course of heating the incoming gases from oven 1 from the oven temperature of about 750° F. The combustion products leaving heat exchanger 89 pass through heat exchange conduit 71 in combustion unit 38. The combustion gases are there further cooled to about 800° F. while assisting in heating the large volume of air being recirculated from oven 1 through the burner section 38.

Combustion products are then passed through heat exchanger 113 where the heat is used to preheat combustion air entering by means of blower 123. The combustion products are cooled to about 500° F. while heating combustion air to a temperature of about 500° F. for use in burners 57 and 58. The system is highly efficient in that the high volume, high velocity recirculation of heated air from oven 1 is effective to raise the temperature of pipe 17 on carts 16 from room temperature to 750° F. in about one and one-half hours. The relatively low volume, low velocity air or gases, laden with combustible volatile materials burned off from pipe 17 is drawn through air pollution control and incinerator unit 43 where it is heated to a high temperature and the combustibles completely burned out. The combustion products at a high temperature are used to provide heat to the air being recirculated from oven 1 in burner section 38 and also to preheat the incoming combustion air for burners 57 and 58 as previously described.

While this invention has been described fully and completely with special emphasis upon a single preferred embodiment, it should be understood that within the scope of the appended claims the invention may be practiced otherwise than as specifically described herein.

I claim:

1. A pipe burnout oven and pollution control and heat recovery system therefor, comprising an elongated, insulated oven chamber for receiving pipe to be heated to burnout temperature, a burner section comprising an insulated burner chamber having an opening communicating with the central portion of said oven chamber for withdrawing air therefrom and a direct fired burner for heating said air for recirculation to said oven chamber, a plurality of blowers connected to said burner chamber and to said oven chamber for recirculating a large volume of heated air at high velocity for heating pipe in said oven chamber, conduit means in said oven chamber extending linearly thereof having an inlet receiving air from said blowers and a plurality of spaced outlets for introducing heated air along the length of said oven chamber, exhaust means for removing air from one end of said oven chamber at a low velocity and low volume, including an insulated combustion chamber including a direct fired incinerator for burning substantially all of the combustible fumes in the air from said oven chamber volatilized in the course of heating pipe to burnout temperature, and heat exchange means for recovering a major part of the heat in the air and combustion products from said incinerator prior to venting to atmosphere by said exhaust means.

2. A pipe burnout oven and pollution control and heat recovery system therefor according to claim 1 in which said conduit means comprises a pair of plenum chambers extending substantially the entire length of said oven chamber on opposite sides thereof, and each of said plenum chambers having said spaced outlets positioned to direct heated air at high velocity and high volume into opposite sides of the pipe positioned in the oven for heating.

3. A pipe burnout oven and pollution control and heat recovery system therefor according to claim 1 or 2 in which said spaced outlets comprise a plurality of vertically extending nozzle slots spaced uniformly along the length of said oven chamber for impinging heated air in a plurality of high velocity jets against the pipe positioned in the oven for heating.

4. A pipe burnout oven and pollution control and heat recovery system therefor according to claim 2 in which there are four of said recirculating blowers positioned to remove heated air from four corners of said burner chamber, and one pair of said recirculating blowers being connected to supply heated air to one of said plenum chambers and the other pair of recirculating blowers to supply heated air to the other plenum chamber.

5. A pipe burnout oven and pollution control and heat recovery system therefor according to claim 1 in which said burner section includes a pair of gas-fired burners positioned on opposite sides thereof and directing flames to mix with and heat the air recirculated from said oven chamber.

6. A pipe burnout oven and pollution control and heat recovery system therefor according to claim 1 in which said direct fired burner is a gas burner having forced circulation of combustion air, and said heat exchange means includes a heat exchanger positioned to receive said heated air and combustion products in heat exchange relation with said combustion air to preheat the same prior to circulation of said air to said gas fired burner.

7. A pipe burnout oven and pollution control and heat recovery system therefor according to claim 1 in which said heat exchange means includes a heat exchanger positioned to conduct said heated air and combustion products through said burner chamber to provide additional heat to the air from said oven chamber being heated by said burner.

8. A pipe burnout oven and pollution control and heat recovery system therefor according to claim 1 in which said exhaust means includes a blower connected to exhaust said heated air and combustion products to atmosphere after passing said heat exchange means.

9. A pipe burnout oven and pollution control and heat recovery system therefor according to claim 8 in which said exhaust means includes a vortex damper controlling air flow through said exhaust blower.

10. A pipe burnout oven and pollution control and heat recovery system therefor according to claim 8 or 9 in which said direct fired burner is a gas burner having forced circulation of combustion air, and said heat exchange means includes a heat exchanger positioned to receive said heated air and combustion products in heat exchange relation with said combustion air to preheat the same prior to circulation of said air to said gas fired burner and to pass said heated air and combustion products to said exhaust blower to be exhausted to atmosphere.

11. A pipe burnout oven and pollution control and heat recovery system therefor according to claim 1 in which said burner section includes a pair of gas-fired burners positioned on opposite sides thereof and directing flames to mix with and heat the air recirculated from said oven chamber, means for supplying a forced circulation of combustion air to each of said gas-fired burners, and said heat exchange means including a heat exchanger positioned to receive said heated air and combustion products in heat exchange relation with said combustion air to preheat the same prior to circulation of said air to said gas fired burners.

12. A pipe burnout oven and pollution control and heat recovery system therefor according to claim 1 in which said conduit means comprising a pair of plenum chambers extending substantially the entire length of said oven chamber on opposite sides thereof, each of said plenum chambers having said spaced outlets positioned to direct heated air at high velocity and high volume into opposite sides of the pipe positioned in the oven for heating, said spaced outlets comprising a plurality of vertically extending nozzle slots spaced uniformly along the length of said oven chamber in each of said plenum chambers for impinging heated air in a plurality of high velocity jets against opposite sides of the pipe positioned in the oven for heating said burner chamber being positioned on top of said oven chamber and said opening being an opening in the bottom of said burner chamber opening directly into the central portion of said oven chamber, said recirculating blowers comprising four blowers positioned to remove heated air from four corners of said burner chamber, and one pair of said recirculating blowers being connected to supply heated air to one of said plenum chambers and the other pair of recirculating blowers to supply heated air to the other plenum chamber.

13. A pipe burnout oven and pollution control and heat recovery system therefor according to claim 12 in which said burner section includes a pair of gas-fired burners positioned on opposite sides thereof and directing flames to mix with and heat the air recirculated from said oven chamber, means for supplying a forced circulation of combustion air to each of said gas-fired burners, said heat exchange means including a heat exchanger positioned to receive said heated air and combustion products in heat exchange relation with said combustion air to preheat the same prior to circulation of said air to said gas fired burners, and said heat exchange means including a heat exchanger positioned in said burner chamber to conduct said heated air and combustion products in heat exchange relation with the air from said oven chamber to provide additional heat thereto.

14. A pipe burnout oven and pollution control and heat recovery system therefor according to claim 1 in which said exhaust means includes a blower connected to exhaust said heated air and combustion products to atmosphere after passing said heat exchange means, and said exhaust means includes a vortex damper controlling air flow through said exhaust blower.

* * * * *